United States Patent [19]

Spear et al.

[11] 4,136,538

[45] Jan. 30, 1979

[54] TREATMENT OF CONTINUOUS TOWELS

[75] Inventors: John F. Spear, Holmbury St. Mary; Maurice C. Lemon, Reigate, both of England

[73] Assignee: Universal Towel Company, Sussex, United Kingdom

[21] Appl. No.: 740,490

[22] Filed: Nov. 10, 1976

[30] Foreign Application Priority Data

Nov. 10, 1975 [GB] United Kingdom ..... 46377/75

[51] Int. Cl.[2] ..... D06B 3/10; D06B 23/00

[52] U.S. Cl. ..... 68/22 R; 68/175; 118/419; 118/424; 226/90; 226/114

[58] Field of Search ..... 68/22 R, 175, 180, 13 R; 118/419, 423, 424; 134/64 P, 122 P; 226/90, 114

[56] References Cited

U.S. PATENT DOCUMENTS

| | | | |
|---|---|---|---|
| 2,979,933 | 4/1961 | Gaino | 68/22 R |
| 3,102,771 | 9/1963 | Neale | 68/175 X |
| 3,526,106 | 9/1970 | Kennedy et al. | 68/13 R |

FOREIGN PATENT DOCUMENTS

| | | | |
|---|---|---|---|
| 312146 | 2/1956 | Switzerland | 68/22 R |
| 588925 | 6/1947 | United Kingdom. | |
| 1094710 | 12/1967 | United Kingdom | 68/22 R |

*Primary Examiner*—Philip R. Coe

*Attorney, Agent, or Firm*—Buell, Blenko & Ziesenheim

[57] ABSTRACT

Apparatus for treating continuous fabric includes a frame on which is mounted an open bath for receiving a treating liquid through which fabric to be treated is passed. An elongate immersion member movably mounted on the frame immerses the fabric in the treating liquid during its passage through the bath, and a pair of squeeze rollers, being an upper and a lower squeeze roller, grip the fabric when it has passed through the bath. At least one roller, preferably the lower squeeze roller, is driven, and at least one roller, preferably the upper squeeze roller is movably mounted on the frame. A driven rewind mandrel is mounted on the frame and the treated fabric having passed through the squeeze rollers is wound thereon. Means are provided for moving the immersion means and the movable squeeze roller their operative and respective inoperative positions.

9 Claims, 4 Drawing Figures

TREATMENT OF CONTINUOUS TOWELS

BACKGROUND TO THE INVENTION

This invention relates to the treatment of continuous fabric, and more particularly but not exclusively to the treatment of continuous towels.

Continuous towels are washed and reused many times during their life. It is conventional that the towels are initially white and then when they become too marked with stains which will not wash out, are dyed blue for further use.

In order to prolong the life of the towels in their white state, it is known to treat the towels with an enzyme and/or detergent to remove the stains by soaking, the towels then being washed in the normal way. Eventually the enzyme and/or detergent is no longer effective and the towels are dyed blue.

SUMMARY OF THE INVENTION

According to the invention apparatus for treating continuous fabric comprises an open bath for reception of a treating liquid and through which fabric to be treated is passed, means for immersing the fabric in the treating liquid during its passage through the bath, a driven rewind mandrel onto which the treated fabric is wound, a pair of squeeze rollers intermediate the treatment bath and the rewind mandrel for gripping the fabric therebetween, at least one of the rollers being driven, and means for moving the immersion means and at least one of the squeeze rollers between their operative positions and respective inoperative positions in which the fabric to be treated may be fed in a roll between the squeeze rollers and between the treatment bath and the immersion means thereby threading the fabric through the apparatus. Subsequently the free end of the fabric is wound onto the rewind mandrel and the immersion means and the squeeze roller or rollers are returned to their operative positions.

Preferably the immersion means and the or each movable squeeze roller are linked for simultaneous movement between their operative and inoperative positions. It is also preferred that the apparatus has a lid, opening and closing of the lid moving the immersion means and the or each squeeze roller into their inoperative and operative positions respectively.

Preferably only the upper squeeze roller of the pair of squeeze rollers is movable into an inoperative position, which movement is effected by lifting the upper squeeze roller.

The immersion means is preferably an elongated member extending, transversely of the fabric being treated and attached to means for lifting the member above the bath, the member also being pivotable about an axis located above and parallel to the member.

Preferably a holder is provided for the roll of fabric to be treated and is preferably located so that it catches the roll after it has been fed between the treatment bath and the immersion means during the loading of the apparatus.

The apparatus preferably includes drive means for the rewind mandrel and the lower squeeze roller.

The treatment bath may include means for maintaining the level of treating liquid at the required level.

The apparatus may include means for detecting when the complete fabric has been treated.

The detecting means may comprise a limit switch located to detect the end of the fabric approaching the rewind mandrel.

Preferably the treating liquid is either an enzyme and/or detergent or a dye.

BRIEF DESCRIPTION OF THE DRAWINGS

By way of example, two specific embodiments in accordance with the invention will now be described with reference to the accompanying drawings in which.

DETAILED DESCRIPTION

Figure 1:
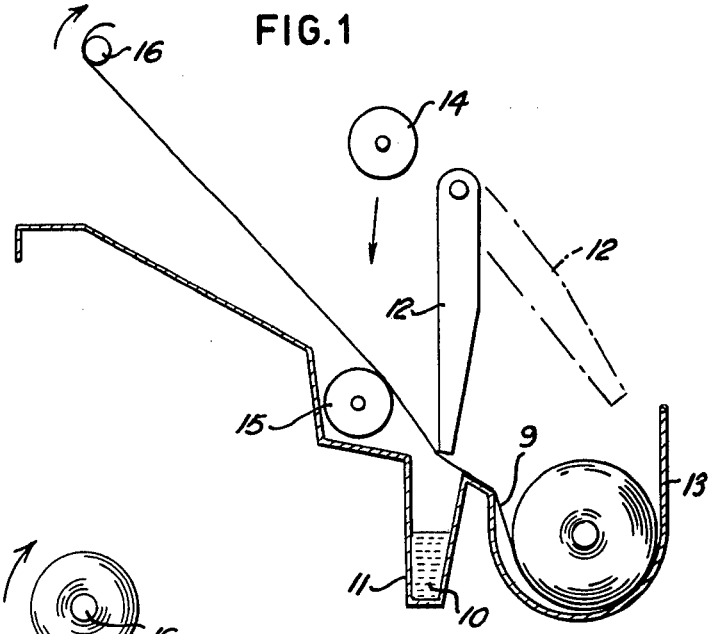
FIG. 1 is a diagrammatic view of a continuous towel treatment apparatus in a state before treatment of a roll of towel.
Figure 2:
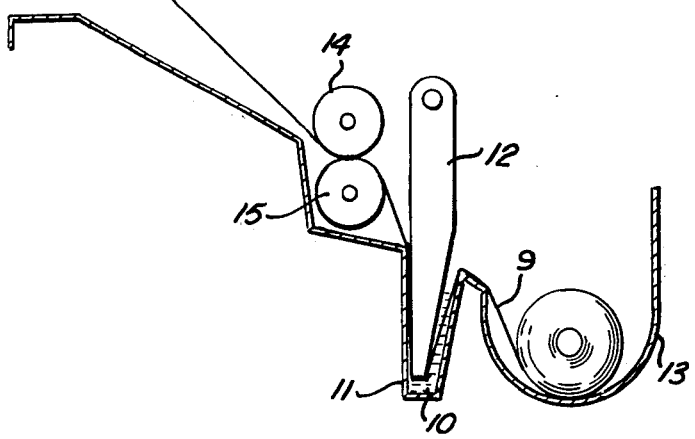
FIG. 2 shows the apparatus of FIG. 1 during treatment of the towel.

Referring to FIGS. 1 and 2, there is shown an apparatus for treating a roll of continuous towel with a treating liquid, which may be either an enzyme and/or detergent or a dye.

The treating liquid 10 is contained in an elongated bath 11, the towel 9 being immersed in the treating liquid in the bath by an elongated member 12 attached to means for lifting the member between an upper position (FIG. 1) and a lower operative position (FIG. 2). The member 12 is also pivotable about a horizontal axis extending longitudinally of the member into an inoperative position indicated in dash lines in FIG. 1.

The treating liquid is supplied to the bath 11 from a tank (not shown) and its level is maintained substantially constant by any convenient means. In this embodiment, the bath 11 is a shallow bath and the lower end of the member 12 has dimensions similar to but smaller than the corresponding dimensions of the bath to minimise the excess amount of treating liquid required in the bath at any given moment. This is especially advantageous in the case of the treating liquid being an enzyme or a mixture of an enzyme and a detergent having a life of perhaps 5 minutes.

Upstream of the treatment bath 10 is a holder 13 for the roll of towel to be treated and from which the towel may readily be withdrawn in an unwound state.

Downstream of the treatment bath is a pair of squeeze rollers 14, 15 and then a rewind mandrel 16. Both the rewind mandrel 16 and the lower squeeze roller 15 are driven by a motor (not shown) about fixed axes. The upper squeeze roller 14 is movable vertically between an upper inoperative position (FIG. 1) and a lower operative position (FIG. 2).

In this embodiment, the upper squeeze roller 14 and the immersion member 12 are linked together and to the lid (not shown) of the apparatus whereby they may be moved together between their operative and inoperative positions by a hydraulic piston and cylinder (not shown) when the lid is opened and closed respectively. The opening and closing movements of the lid, in this embodiment, also stop and start the motor driving the lower squeeze roller 15 and the rewind mandrel 16.

In operation, the lid of the apparatus is opened manually and thereby the upper squeeze roller 14 is raised and the immersion member 12 both raised and pivoted into their inoperative positions. A roll of towel 19 to be treated is then taken and with its free end held adjacent the rewind mandrel 16, the roll is fed between the squeeze rollers and beneath the immersion members into the holder 13. The free end of the towel is wrapped around the rewind mandrel. The lid is then closed thereby lowering the upper squeeze roller 14 and both pivoting and lowering the immersion member 12 into their operative positions. The towel is thereby threaded through the apparatus and immersed in the treating liquid. Closing of the lid also starts the motor for driving the rewind mandrel 16 and the lower squeeze roller 15, and the towel 19 is successively withdrawn from the holder 13, passed through the treating liquid 10, squeezed by the rollers 14, 15 and rewound on the mandrel 16. The lid is then raised thereby stopping the motor and the treated roll of towel is removed from the apparatus. If the treating liquid is an enzyme and/or detergent, the treated roll of towel is left to soak and then washed. Alternatively, if the liquid is a dye, the treated roll is dried and is then ready for reuse.

The invention is not restricted to the specific details of the embodiment described above. For example, the immersion member 12 may only be raised by opening of the lid, the member being freely pivotable, at least between its two positions shown in FIG. 1, whereby the roll of towel to be treated pivots the member in order to pass beneath the member during the step of threading the towel to be treated through the apparatus, the member then swinging back into its position shown in full lines in FIG. 1.

Also, the upper squeeze roller 14 and the immersion member 12 may be moved between their operative and inoperative positions independently both of each other and the lid of the apparatus.

Furthermore, the roles of the squeeze rollers may be reversed, or indeed both squeeze rollers may be moved apart into inoperative positions in order that the roll of towel to be treated may be passed between them.

Figure 3:
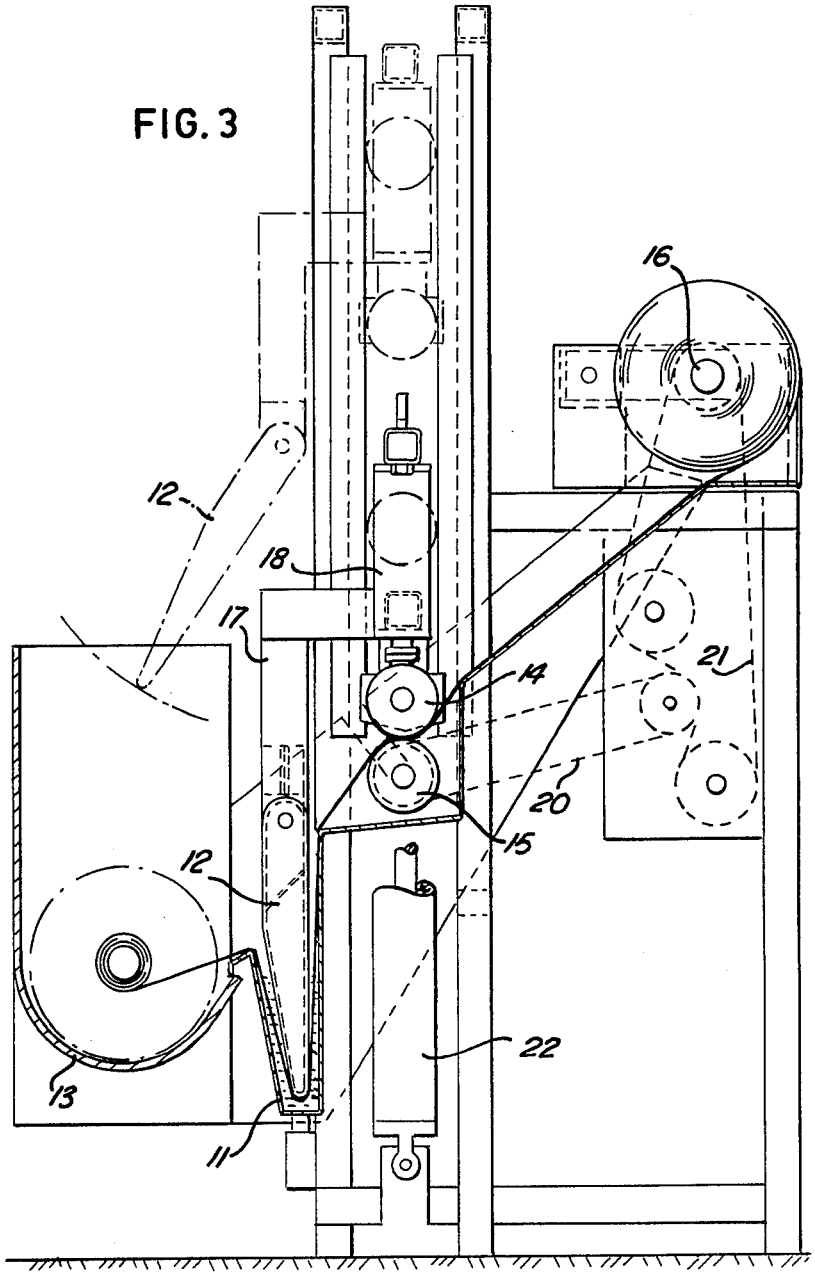
FIG. 3 is an elevation of one form of treatment apparatus incorporating the principle of operation of the apparatus of FIGS. 1 and 2.

FIG. 3 shows one form of treatment apparatus incorporating the principle of operation of the apparatus described above, and the same reference numberals have been used for comparative features of the apparatus. The upper end of the immersion member 12 is pivotally attached to a bracket 17 carried by a frame 18 from which the upper squeeze roller 14 is suspended. The frame is attached to the upper end of a piston of a hydraulic or pneumatic jack 22 whereby extension of the jack will raise the upper squeeze roller 14 and the immersion member 12 to allow a soiled towel to be fed as a roll through the apparatus into the holder 13 from the direction of the rewind mandrel 16. Contraction of the jack 22 returns the upper squeeze roller and the immersion member to their operative positions. The lower squeeze roller 15 and the rewind mandrel 16 are driven by respective chain or belt drives 20, 21 both of which are driven by the same output shaft of an electric motor.

Figure 4:
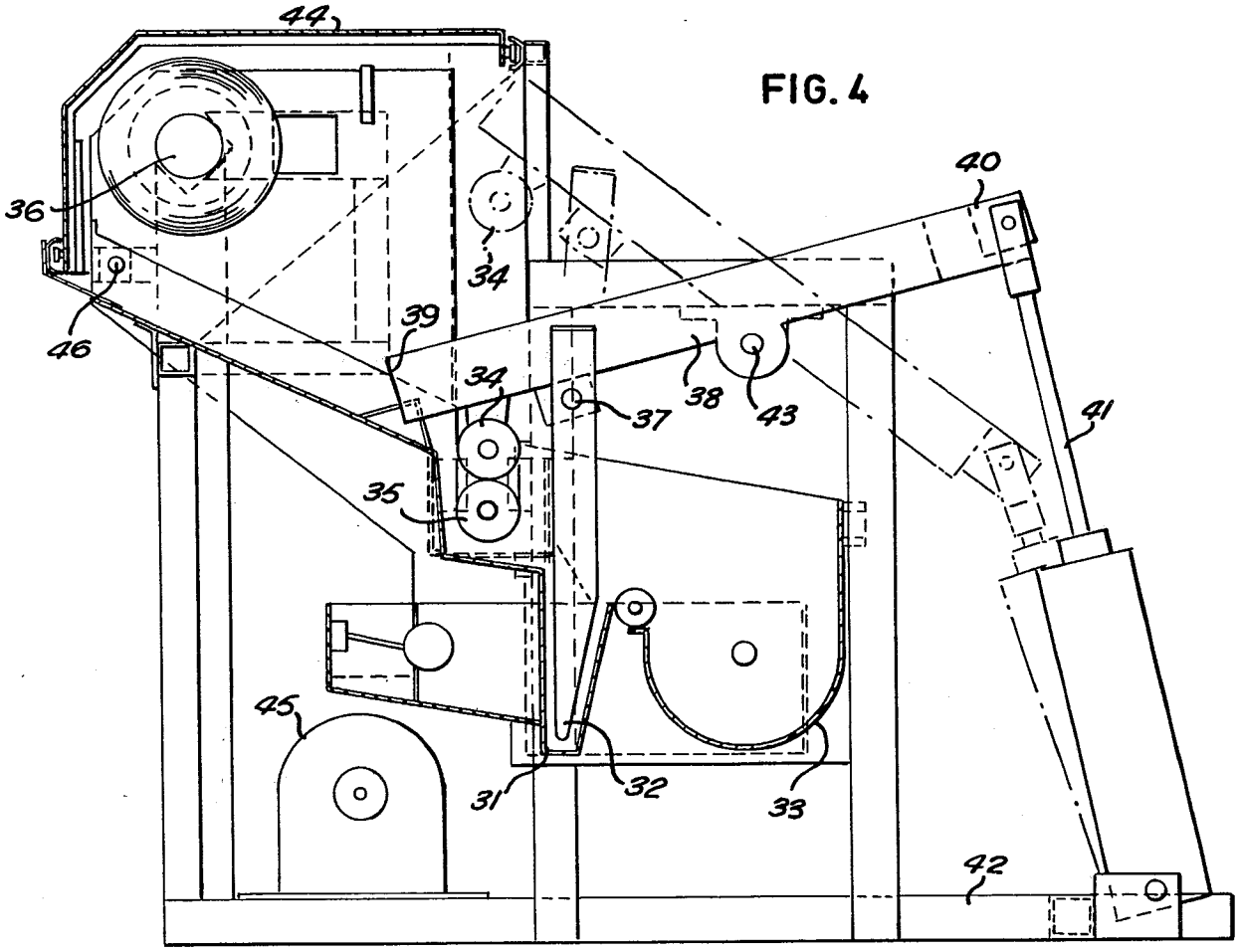
FIG. 4 is an elevation of a second form of treatment apparatus incorporating the principle of operation of the apparatus of FIGS. 1 and 2.

FIG. 4 shows a second form of treatment apparatus incorporating the principle of operation of apparatus described with reference to FIGS. 1 and 2.

Immersion member 32 is pivotally attached at a point 37 near its upper end to a beam 38. Also attached to the beam 38 is upper squeeze roller 34. The beam has one end 39 free and the other end 40 pivotally attached to one end of a hydraulic ram 41, the other end of the hydraulic ram being pivotally attached to supporting frame 42. The beam 38 is pivotally supported near its mid point by a shaft 43. The arrangement of the beam 38 is such that when the hydraulic or pneumatic ram 41 is extended, the immersion member 32 and upper squeeze roller 34 are in their respective operative positions, and when the ram 41 is contracted the immersion member 32 and upper squeeze roller 34 are in their respective inoperative positions.

To load a soiled roll of towel to be treated, lid 44 is slid to the open position, and thereby activates ram 41 to rotate beam 38 and move immersion member 32 and upper squeeze roller 34 to their respective inoperative positions. The free end of the towel is held adjacent rewind roller 36 and the roll is passed between squeeze rollers 34 and 35 and between the immersion member 32 and bath 31 and placed in holder 33. The free end of the towel is then wound onto the rewind mandrel and the lid 44 slid to the closed position, the sliding of the lid 44 activating the ram 41 to return the immersion member 32 and the upper squeeze roller 34 to their respective operative position.

With the lid 44 in the closed position a starter switch (not shown) is exposed, the starter switch controlling electric motor 45 which drives the rewind mandrel 36 and lower squeeze roller 35 by means of a belt system (not shown). The rewind mandrel is driven through a slipping clutch (not shown) in order to allow the angular velocity of the rewind mandrel to change according to the size of the roll wound thereon and thereby to allow a constant linear velocity for the towel passing through the bath 31 to be maintained.

When the complete towel has been treated and passed through the squeeze rollers 34 and 35 a limit switch 46 detects the passing of the end of the towel and stops the motor 45. With the towel end having passed through the squeeze rollers 34 and 35 and, there is no longer tension in the towel, and with continuing rotation of the rewind mandrel the end of the towel rotates clockwise and in doing so contacts limit switch 46 to switch off electric motor 45.

We claim:

1. Apparatus for treating a roll of continuous fabric passing from a roll to a rewind mandrel forming a new treated roll which comprises:

(a) a frame;

(b) an open roll holder on said frame for catching and cradling a roll of fabric for treatment;

(c) an open bath mounted on the frame adjacent the roll holder for reception of a treating liquid and through which fabric to be treated is passed;

(d) a member pivotally mounted on the frame for immersing the fabric in the treating liquid during its passage through the bath, which member may be moved from its operative position in a lifting and pivoting movement into an inoperative position away from the bath to allow a roll of fabric to be thrown between the immersing member and the bath into the roll holder;

(e) a pair of squeeze rollers, being an upper squeeze roller and a lower squeeze roller mounted on the frame for gripping the fabric when it has passed through the bath, at least one of said rollers being driven and at least one of said rollers being movably mounted for movement from its operative position in which the fabric is gripped into an inoperative position in which the rollers are separated to allow a roll of the fabric to be thrown between said rollers into the roll holder;

(f) a driven rewind mandrel mounted on the frame onto which the treated fabric having passed through the squeeze rollers is wound directly; and (g) means mounted on the frame for simultaneously lifting the immersing member and effecting movement of said at least one movable squeeze roller from their operative position to their respective inoperative positions whereby the free end of a new roll of fabric may be attached to the rewind mandrel and the remainder of the roll thrown between the immersing member and bath and between the squeeze rollers into the roll holder, and for subsequently returning the immersing member and said one movable squeeze roller to their operative position.

2. Apparatus for treating a roll of continuous fabric as claimed in claim 1 further comprising means linking the immersing member and said at least one movable squeeze roller for the simultaneous movement between their operative and inoperative positions.

3. Apparatus for treating a roll of continuous fabric as claimed in claim 1 further comprising a lid mounted on the frame adjacent the rewind mandrel to cover said mandrel, and means on the frame and engaged by said lid whereby, opening and closing the lid causes at least said lifting movement of the immersing member and said movement of said at least one movable squeeze roller into their inoperative and operative positions respectively.

4. Apparatus for treating a roll of continuous fabric as claimed in claim 1 wherein the upper squeeze roller of the pair of squeeze rollers is movable into an inoperative position, which movement is effected by lifting the upper squeeze roller.

5. Apparatus for treating a roll of continuous fabric as claimed in claim 1 wherein the immersing member is an elongated member extending transversely of the fabric being treated and attached to means for at least lifting the member above the bath.

6. Apparatus for treating a roll of continuous fabric as claimed in claim 1 wherein the lower squeeze roller is driven.

7. Apparatus for treating a roll of continuous fabric as claimed in claim 1 further comprising means mounted on the frame for detecting when the complete roll of fabric has been treated.

8. Apparatus for treating a roll of continuous fabric as claimed in claim 7 wherein the detecting means comprises a limit switch located to detect the end of the fabric approaching the rewind mandrel.

9. Apparatus for treating a roll of continuous fabric as claimed in claim 1 wherein the treating liquid is liquid selected from the group consisting of an enzyme, a detergent, an enzyme and a detergent combined, and a dye.

* * * * *